US006588657B2

(12) United States Patent
Vega

(10) Patent No.: US 6,588,657 B2
(45) Date of Patent: Jul. 8, 2003

(54) FLUIDIC DATA REGISTER AND DISPLAY

(75) Inventor: Ramon Vega, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 235 days.

(21) Appl. No.: 09/843,880

(22) Filed: Apr. 30, 2001

(65) Prior Publication Data

US 2002/0158119 A1 Oct. 31, 2002

(51) Int. Cl.[7] ..... G06D 1/00

(52) U.S. Cl. ..... 235/200 R; 235/201 FS; 235/200 PF

(58) Field of Search ..... 235/200 R, 200 PF, 235/201 FS; 137/806, 112

(56) References Cited

U.S. PATENT DOCUMENTS 3,825,739 A * 7/1974 Richards et al. ..... 235/201 PF
5,898,393 A * 4/1999 Werner ..... 341/55
6,484,805 B1 * 11/2002 Perkins et al. ..... 166/305.1

* cited by examiner

*Primary Examiner*—Michael G. Lee
*Assistant Examiner*—Ahshik Kim

(57) ABSTRACT

Fluidic registers hold different types fluids to represent data. The fluids are substantially immiscible with respect to each other. Typically, two types of data (or fluids) may be held within the fluidic register representing binary data. However, more than two types may be held. The fluids remain static within the fluidic registers when no external force is applied, i.e., the data is non-volatile. Also, if the fluids within the registers are visible, then no intermediate device is required for a user to interpret the data. The data within the registers may be reversible. Further, the registers may be made to be flexible to meet space requirements or to produce visual effects. The registers may be of varying size—from, for example, on the scale of ink jets to advertising bill boards. Still further, images represented in the registers may be enhanced by implementing various types of backgrounds.

26 Claims, 7 Drawing Sheets

FLUIDIC DATA REGISTER AND DISPLAY

FIELD OF THE INVENTION

This invention relates generally to a register for storing data. More particularly, the invention relates to a fluidic register that stores data in fluidic states and to display devices using at least one fluidic register.

BACKGROUND OF THE INVENTION

Digital data is typically stored as a bit stream, i.e., as a sequence of zeros and ones, in a data unit. In general, a data unit exhibits at least two different states in which one state is interpreted as a zero and the other state is interpreted as a one. For example, a digital random access memory (RAM) stores different voltage levels such as ground voltage and 5 volts (or nominal values thereof), being respectively interpreted as a zero and a one and vice versa. However, RAMs require power to be applied at all times, else all data is lost when power is no longer available. In other words, RAMs are volatile.

Conventional forms of non-volatile data storage typically include read-only memories (ROM), magnetic disk storage, magneto-optical disks, tapes, etc. However, conventional data storage forms suffer from a variety of drawbacks and difficulties. For instance, these types of non-volatile data storage forms may not be interpreted without the use of an intermediate device (e.g., a disk drive), before being displayed to a user on a computer monitor. Furthermore, traditional data storage devices are capable of keeping only binary data and are thus relatively limited in the applications for which they may be utilized.

SUMMARY OF THE INVENTION

In accordance with the principles of the present invention, a fluidic data storage device includes a fluidic register having a first end and a second end. The fluids insertable into the fluidic storage device are supplied by a first fluid supply and a second fluid supply. Additionally, the first and second fluids are substantially immiscible with respect to each other.

According to another aspect, the present invention pertains to a method of storing data in fluidic form. In the method, a first fluid is pumped from a first fluid supply into a fluidic register having a first end and a second end. Additionally, a second fluid, which is substantially immiscible with respect to the first fluid, is pumped from a second fluid supply into the fluidic register, such that the first and second fluids are pumped into the fluidic register in accordance with the information the fluidic register is configured to store.

In accordance with another aspect, the present invention pertains to a fluidic data storage device. The fluidic data storage device includes at least one fluidic register possessing first and second ends and at least a first fluid supply for supplying a first fluid into the fluidic register. The device also includes at least one second fluid supply for supplying a second fluid, which is relatively immiscible with the first fluid, into the fluidic register and at least one pump operable to pump the first and second fluids from the first and second fluid supplies to the fluidic register and at least one controller for controlling an operation of the at least one pump.

Certain advantages follow from certain embodiments of the invention. They include (1) non-volatility of data, (2) interpretation of data without the need for intermediate devices, and (3) enhanced data storage capabilities.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to exemplary embodiments of fluidic data storage and display devices. However, one of ordinary skill in the art would readily recognize that the same principles are equally applicable to all types of fluidic registers and to display devices using fluidic registers.

Figure 1A:
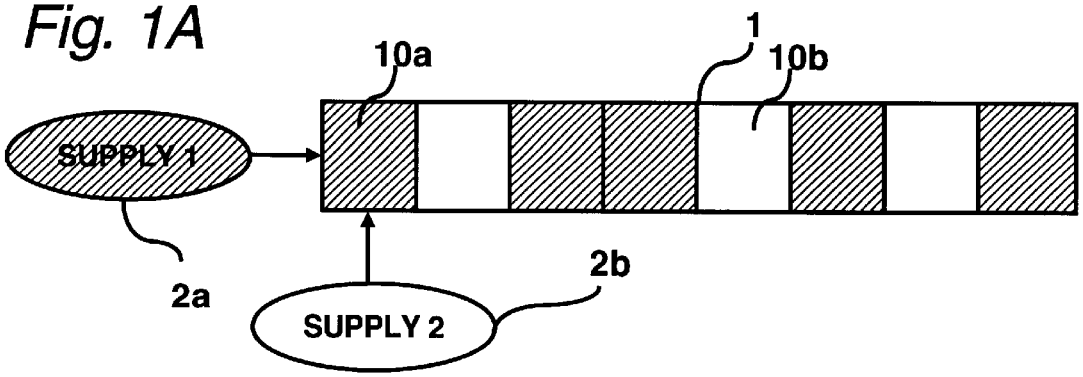
FIG. 1A is a simplified schematic illustration of a fluidic register and fluid supplies in accordance with the principles of the present invention.

A simplified schematic illustration of a fluidic register 1 is shown in FIG. 1A. In this figure, the fluidic register 1 is of sufficient length to hold eight (8) bits (one byte) of information. In this respect, one cell of fluid 10*a* or 10*b* represents one byte of information. According to the principles of the present invention, the cells of fluids 10*a*, 10*b* are prevented from mixing with fluids having varying characteristics based upon their substantial immiscibility with respect to one another, as will be described in greater detail hereinbelow. Although the present invention is described with specific reference to two types of fluids, it is to be understood that the present invention may be practiced with any reasonable number of fluids without deviating from the and of the present invention.

It is to be understood that the length of the register is not restricted to the length shown in FIG. 1A. Instead, it is within the purview of the present invention that the fluidic register 1 may be of any reasonable length and may comprise any reasonable number of fluids. Accordingly, the eight (8) bit length of the fluidic register 1 is not intended to restrict the present invention in any respect. In the fluidic register 1 illustrated in FIG. 1A, two types of fluid—a dark fluid 10*a* a light fluid 10*b*—are used. The two types of fluids may be configured to represent a variety of information. For example, if the light fluid 10*b* represents a zero (0) and the dark fluid 10*a* represents a one (1), then the bit sequence of the information represented in the fluidic register is 01011010.

However, opacity (light and dark) is not the only means by which the fluids may be distinguished from one another and thus, information may be stored by the fluidic register 1. Instead, as long as at least two different states may be read, data storage by means of the fluid register 1 is possible. For example, the fluids 10*a*, 10*b* may exhibit different magnetic, electrical, and color states as well. Thus, if various magnetic properties are used to distinguish the fluids 10*a*, 10*b*, the fluids in the fluidic register 1 may be such that fluid 10*a* is magnetically charged, whereas fluid 10*b* is not magnetically charged.

Although particular reference has been made to certain techniques for distinguishing the fluids 10*a*, 10*b*, it is within the purview of the present invention that the distinguishing fluid characteristics are not limited to those enumerated hereinabove. Instead, the techniques by which the fluids 10*a*, 10*b* may be distinguished with respect to each other may be determined by the satisfaction of the following two conditions. First, the cells of fluids 1*a*, 10*b* must remain substantially static when no action takes place. Second, the different data states, i.e., fluids, must not interact (e.g., they must be substantially immiscible) with respect to each other.

The first condition may be satisfied by the use of a storage tube similar to the fluidic register 1 illustrated in FIG. 1A. Essentially, the fluids 10*a*, 10*b* within the tube are relatively trapped in the absence of any force. The fluids 10*a*, 10*b* within the tube are configured to move substantially only if they are made to do so by some external force. The second condition may be satisfied if the different types of fluids 10*a*, 10*b* are such that each fluid is non-soluble or non-reactive with respect to other fluids utilized in the fluidic register 1.

It is preferred that both fluids be liquid because liquids are not generally compressible and thus controlling their volume is relatively non-problematic. However, it is within the purview of the present invention that the fluids may comprise gases as well without departing from the scope and spirit of the present invention.

As noted above, the opacities of the various fluids are not the only means by which data may be represented. However, for purposes of illustration, various opacities of the fluids are depicted as a distinguishing feature between the fluids 10*a*, 10*b* throughout the remainder of the present disclosure.

Figure 2:
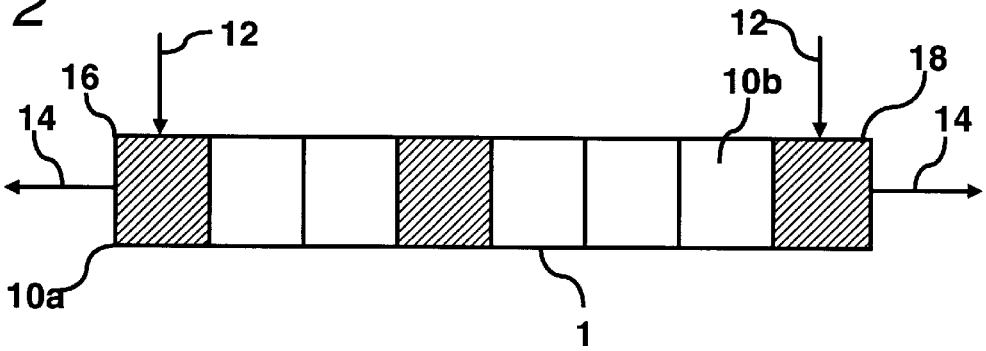
FIG. 2 illustrates the fluidic register of FIG. 1A having a reversible data flow in accordance with the principles of the present invention.

With further reference to FIG. 1A, it is seen that the fluids 10*a*, 10*b* may be separately supplied into the fluidic register 1. In this regard, FIG. 2 illustrates the fluidic register 1 receiving a fluid 10*a* from a supply 2*a* and a fluid 10*b* from a supply 2*b*. In one respect, the fluidic register 1 may include a plurality of openings through which the fluids 10*a*, 10*b* may be injected. However, according to another respect, the fluidic register 1 may include a shared opening for the injection therein of the fluids 10*a*, 10*b*. Although FIG. 1A illustrates the fluids 10*a* and 10*b* as being separately supplied from the two supplies 2*a*, 2*b*, the fluidic register 1 may operate with the fluids supplied from a single source. In this instance, either the fluid source is equipped with a mechanism, or a mechanism (not shown) is situated between the fluid source and the fluidic register 1 to separate the different types of fluids before injection of the fluids into the fluidic register 1.

Figure 1B:
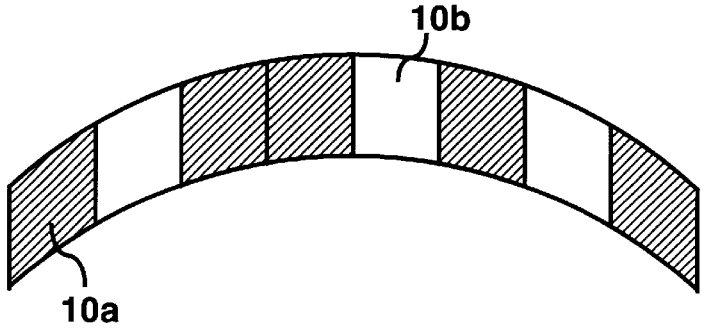
FIG. 1B is similar to FIG. 1A except that the fluidic register is illustrated as being flexible.

FIG. 1B is a schematic illustration of a fluidic register 1 that may be bent. The fluidic register 1 illustrated in this figure may be useful when it is desired to shape the fluidic register into a plurality of shapes. For example, there may be a situation that requires the fluidic register 1 to be shaped in a certain manner to fit into a given space while still allowing for the fluids 10*a*, 10*b* to be inserted and ejected from the fluidic register. Thus, it may be seen from FIG. 1B that the fluidic register 1 of the present invention is not limited to any specific shape.

With reference to FIG. 2, it may be seen that the data flow, (i.e., fluid flow), into and out of the fluidic register 1 may be reversible. That is, the fluids 10*a* and 10*b* may be inserted into the fluidic register 1 from either end 16, 18 thereof. The arrows 12 directed toward the fluidic register 1 indicate that fluids 10*a*, 10*b* may be supplied into the fluidic register and the arrows 14 directed away from the fluidic register indicate that the fluids may be removed from the fluidic register. Thus, as a fluid 10*a*, 10*b* is inserted into the fluidic register 1 through one side, for example, end 16, another fluid 10*a*, 10*b*, may be ejected from the other side, for example, end 18. Additionally, as illustrated in FIG. 3, this process may be reversed, that is, fluid 10*a*, 10*b* may be inserted through the end 18 with another fluid being ejected from the other end 16. In this respect, the fluids 10*a*, 10*b*, may be arranged into various serial configurations to vary the data stored in the fluidic register 1.

Figure 3A:
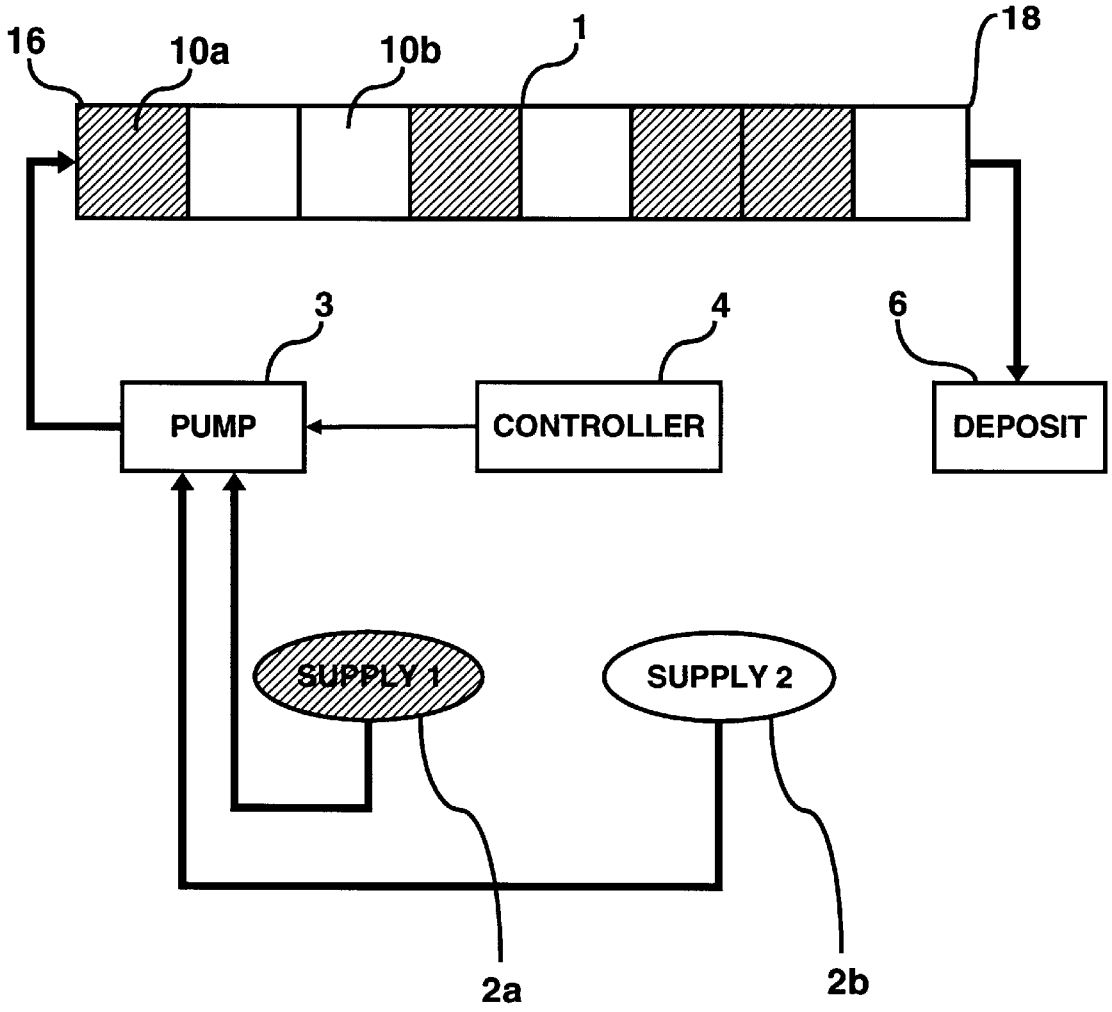
FIG. 3A is a schematic illustration of a fluidic data storage device that utilizes a single pump operable to pump two types of fluids into the fluidic register of FIG. 1A.

FIGS. 3A–3D are schematic illustrations of various embodiments of a fluidic data storage device according to the principles of the present invention. In FIG. 3A, a fluidic data storage device includes a fluidic register 1, a first fluid supply 2*a* storing a first fluid 10*a*, a second fluid supply 2*b* storing a second fluid 10*b*, a pump 3 for intaking the first and second fluids 10*a*, 10*b* from the first and second fluid supplies 2*a* and 2*b*, and for outputting the first and second fluids into the fluidic register 1, and a controller 4 for controlling the operation of the pump 3.

In use, the fluidic register 1 holds the first and second fluids 10*a*, 10*b* as cells, with each cell representing a data bit. A cell, as is used throughout the present disclosure, is defined as a column of a fluid located within the fluidic register 1. The first and second fluids 10*a*, 10*b* are respectively supplied in the first and second fluid supplies 2*a* and 2*b*. The pump 3, under the control of the controller 4, pumps the first and second fluids 10*a*, 10*b* from the first and second fluid supplies 2*a* and 2*b* into the fluidic register 1.

As the pump 3 pumps one cell of fluid into a first end 16 of the fluidic register 1, one cell of fluid is ejected from a second end 18 due to the force of the pumping action. The cell of fluid that is ejected from the fluidic register 1 may be stored in a deposit 6 for later discarding or for replenishing the fluid supplies 2*a* and 2*b*. In this respect, by controlling the configuration of the fluids 10*a*, 10*b* inserted into the fluidic register 1, the fluids may be configured to represent certain data. According to an aspect of the present invention, the fluids 10*a*, 10*b* within the fluidic register 1 may be visible through the fluidic register to thus enable the a user to interpret the data stored within the fluidic register without requiring that reader device be used. However, a sensor (not shown) may be attached to interpret the data in the fluidic register 1.

In this and other embodiments, the fluidic register 1 is illustrated as holding one byte of information. However, as previously mentioned, the fluidic register 1 may comprise any length, subject to practical limitations. For example, the amount of force the pump 3 may apply to insert the fluids 10*a*, 10*b* may limit how much total fluid may be stored in the fluidic register 1 at any one time.

Also, in this and certain other embodiments, two different types of fluids 10*a*, 10*b* are shown, i.e., binary data is represented by these fluids. However, the present invention may contain more than two different types of fluids. For example, if three types of fluids are used, then ternary information may be stored in the fluidic register 1. In this instance, no one of the three fluid types may react with any of the other two types (i.e., the fluids are relatively immiscible with respect to each other). Additionally, this concept may be easily extended to more than three types of fluids. Accordingly, the present invention is not limited to use of any set number of differing types of fluids, but instead, may utilize any reasonable number of different types of fluids to both store information and for display purposes.

Figure 3B:
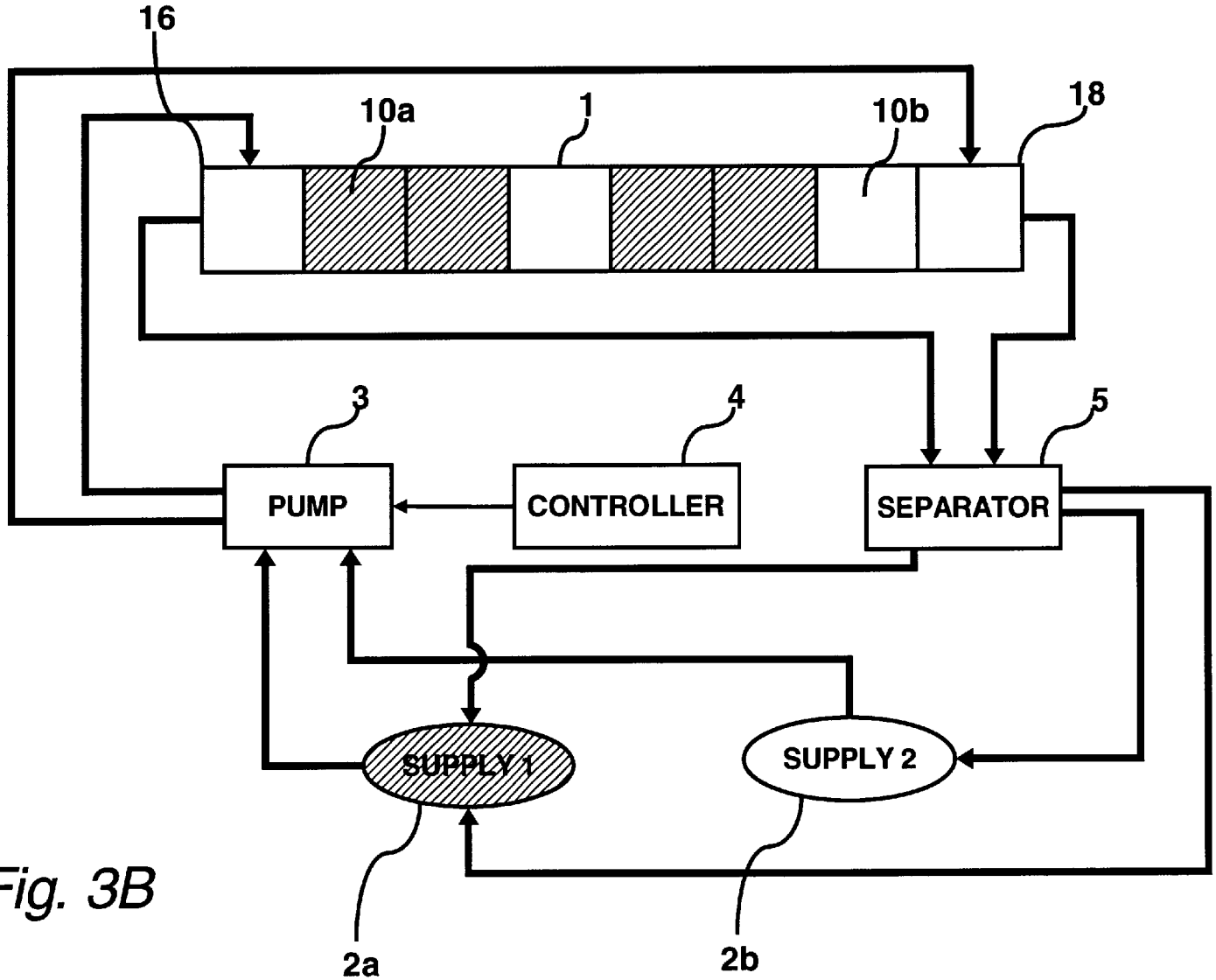
FIG. 3B is a schematic illustration of a reversible data flow data storage device similar to that illustrated in FIG. 2.

FIG. 3B is a schematic illustration of a second embodiment of a fluidic data storage device in accordance with the principles of the present invention. The second embodiment illustrated in FIG. 3B includes all of the elements shown in FIG. 3A. However, extra connections are illustrated between the pump 3 and the fluidic register 1 to make the fluid flow into and out of the fluidic register reversible. As shown in FIG. 3B, the pump 3 is operable to pump the fluids 10*a*, 10*b* into both ends 16, 18 of the fluidic register 1.

Additionally, the fluidic register 1 is connected to a fluid separator 5 along both ends 16, 18 thereof to enable fluid to flow to the fluid separator. The fluid separator 5 is operable to separate the various types of fluids stored in the fluidic register 1 and to feed the separated fluids back to the their respective supplies 2*a*, 2*b*. The controller 4 is operable to control the pump 3 to pump data (i.e., fluid) in either end 16, 18 of the fluidic register 1. Thus, the data (i.e., fluid) stored in the fluidic register 1 may be manipulated to portray and store meaningful data and such manipulation may be accomplished by the insertion and ejection of the various fluids 10*a*, 10*b* into either end 16, 18 of the fluidic register.

Figure 3C:
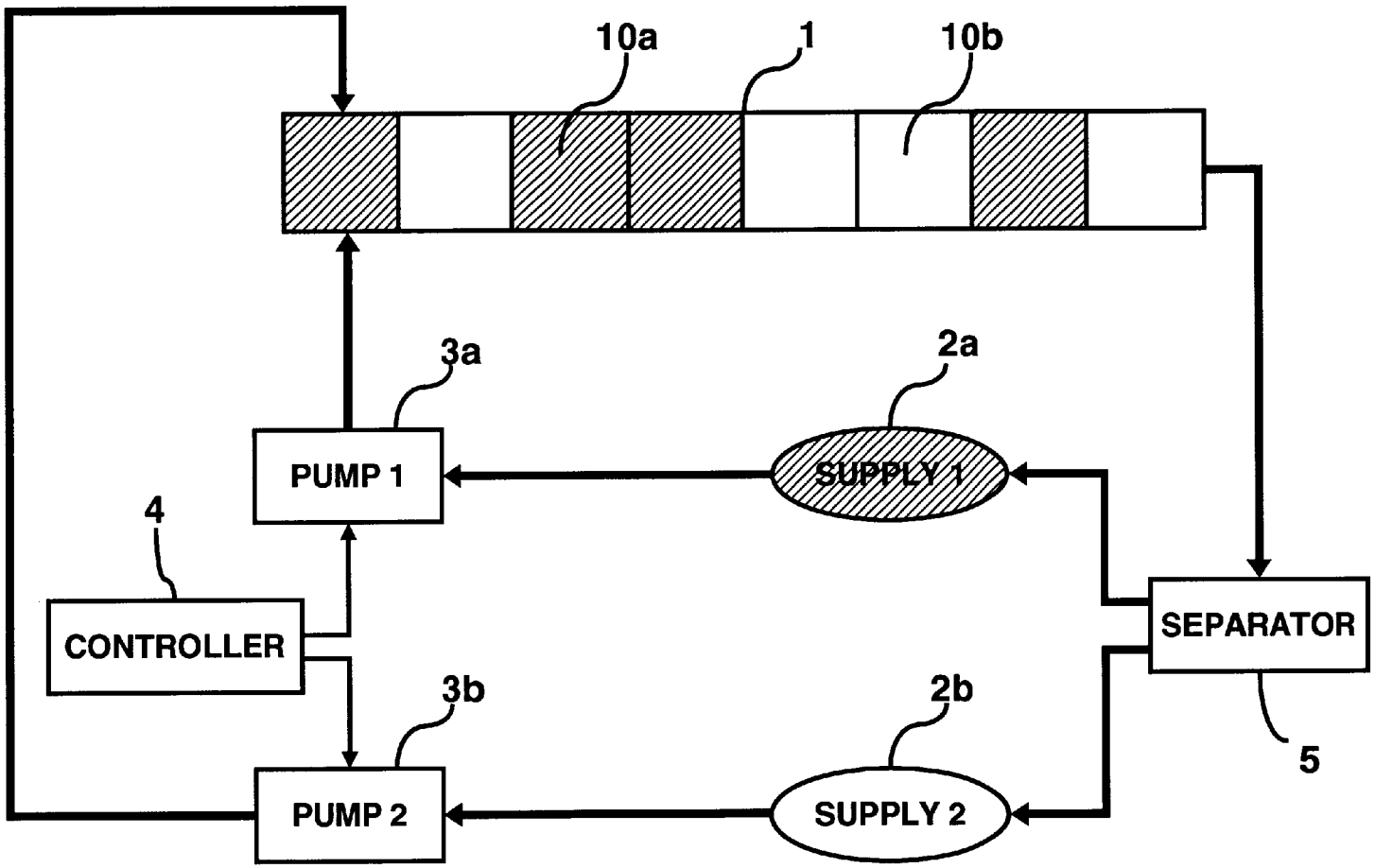
FIG. 3C is a schematic illustration of a fluidic data storage device utilizing two pumps, in which each pump is operable to one of fluid into the fluidic register illustrated in FIG. 1A.

FIG. 3C illustrates a third embodiment of the fluidic data storage device in accordance with the principles of the present invention. The third embodiment is similar to the first embodiment shown in FIG. 3A, except, in this embodiment, a plurality of pumps 3*a* and 3*b* are illustrated. In this respect, FIG. 3A illustrates that a first pump 3*a* and a second pump 3*b* are provided to individually pump fluid from respective the fluid supplies 2*a*, 2*b*. As shown in FIG. 3C, the first pump 3*a* pumps the first fluid 10*a* from the first fluid supply 2*a* and the second pump 3*b* pumps the second fluid 10*b* from the second fluid supply 2*b*. The controller 4 controls both the first and second pumps 3*a* and 3*b*. Other elements illustrated in FIG. 3C behave similarly to the elements illustrated in FIG. 3A.

Figure 3D:
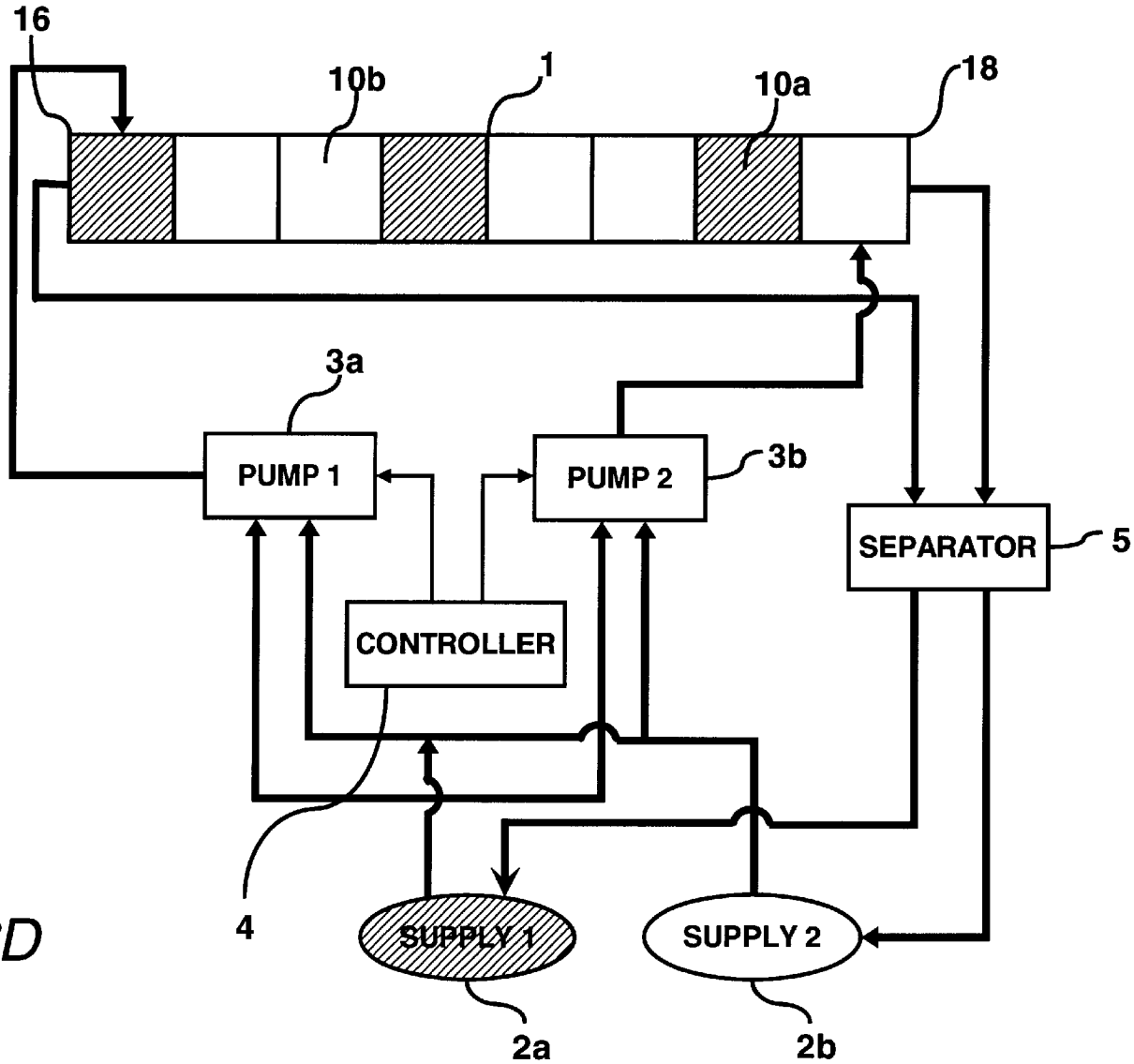
FIG. 3D is a schematic illustration of a reversible data flow data storage device utilizing two pumps, in which one pump is operable to pump two types of fluids into one end of the fluidic register illustrated in FIG. 1A and the other pump is operable to pump two types of fluids into the other end of the fluidic register illustrated in FIG. 1A.

FIG. 3D illustrates a fourth embodiment of the fluidic data storage device in accordance with the principles of the present invention. The fourth embodiment is similar to the second embodiment as shown in FIG. 3B, in that, data (i.e., fluid) flow is reversible. According to the fourth embodiment, a plurality of pumps 3*a*, 3*b* are operable to feed the fluids 10*a*, 10*b* into both ends 16, 18 of the fluidic register 1. As shown in FIG. 3D, a first pump 3*a* is operable to pump both the first and second fluids 10*a*, 10*b* from their respective supplies 2*a*, 2*b* to a first end 16 of the fluidic register 1 and a second pump 3*b* is operable to pump both the first and second fluids from their respective supplies, but to a second end 18 of the fluidic register 1. Additionally, each end 16, 18 of the fluidic register 1 is connected to a fluid separator 5 to thus allow ejected fluids to be stored in their respective supplies 2*a*, 2*b*.

Although in the descriptions of the embodiments illustrated in FIGS. 3B–3D specific references to the use of a fluid separator 5 were made, it is within the purview of the present invention that a deposit 6 (FIG. 3A) may be substituted for the fluid separator 5 when a fluid separator is not required or when it is more beneficial to utilize a deposit. For example, it may be suitable to utilize a deposit 6 when the information stored in the fluidic register 1 is to remain static for relatively long time to thus simplify and make relatively less expensive the costs of operating the fluidic register.

Figure 4A:
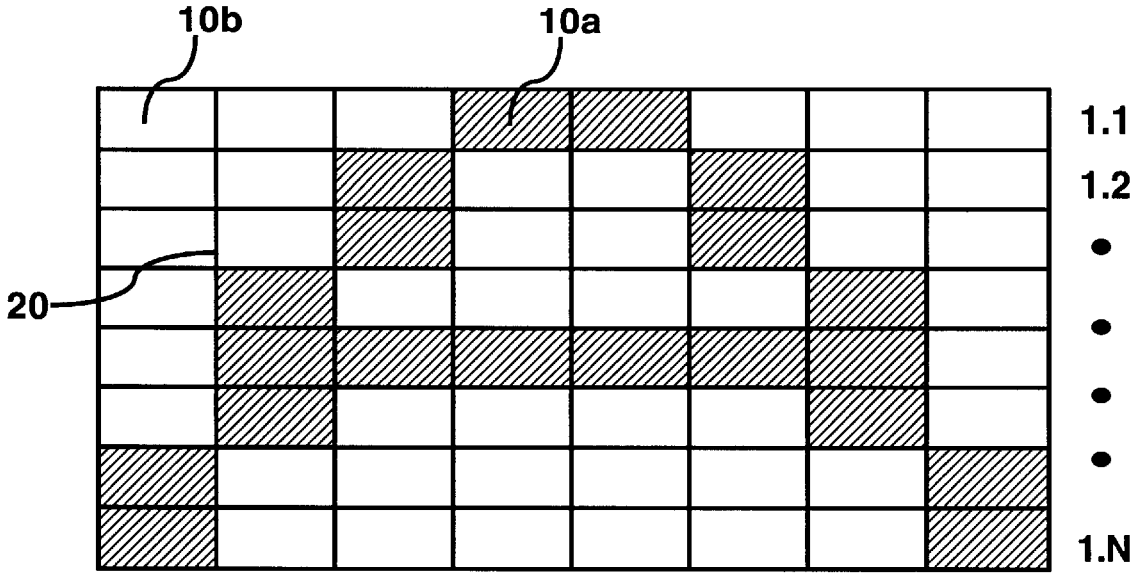
FIG. 4A is a schematic illustration of multiple fluidic registers illustrating a manner in which a plurality of fluidic registers may be utilized as a display device in accordance with the principles of the present invention.

In FIG. 4A, multiple fluidic registers 1.1–1.N are illustrated as being positioned along a series to enable an image to be created by the fluidic registers. As seen in FIG. 4A, the fluids 10*a*, 10*b* within the fluidic registers 1.1–1.N have been manipulated to form a discernable shape 20. In this instance, FIG. 4A illustrates the letter "A". However, it is within the purview of the present invention that any reasonable discernable shape may be created by various combinations of the fluids 10*a*, 10*b* within each of the fluidic registers 1.1–1.N. Additionally, the present invention is not limited to eight (8) cells of fluids per each fluidic register 1.1–1.N, but instead, each fluidic register may comprise any reasonable number of cells. In this respect, the principles of the present invention may be utilized to create rather large and complex shapes and figures. Additionally, fluids having various colors, e.g., red, green, blue, etc., may also be incorporated in the fluidic registers 1.1–1.N to enhance the aesthetic qualities of the displayed images.

The fluidic registers 1.1–1.N of the present invention are not limited to any particular size. Instead, the fluidic registers 1.1–1.N may comprise any of a multitude of sizes. For example, the fluidic registers 1 may be very small, such as on a scale comparable to ink jets, e.g., 10 point font. Moreover, the fluidic registers 1.1–1.N may be considerably large, such as on a scale comparable to a bill board. In this respect, the fluidic registers 1.1–1.N may be configured to display text and images for advertisements. In addition, because the fluids 10*a*, 10*b* may be moved within the fluidic registers 1.1–1.N, the data may be scrolled at certain times, thereby producing a scrolling image and/or enabling for various images to be displayed from the same set of fluidic registers 1.1–1.N. Also, because the direction of data (i.e., fluid) flow may be reversed, the data represented by the fluidic registers 1.1–1.N may also be scrolled in either direction. Further, a direction of data (i.e., fluid) flow may be individually controlled for each fluidic register to thus allow for varied visual effects.

Figure 4B:
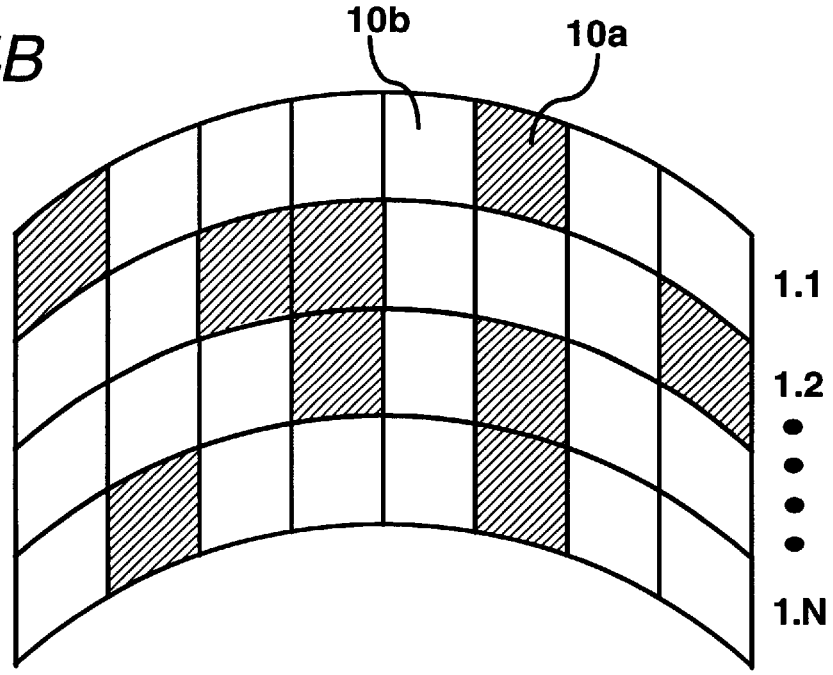
FIG. 4B is a schematic illustration of a plurality of flexible fluidic registers utilized as a display device in which the plurality of flexible fluidic registers have been arranged in a curved configuration.

Furthermore, as shown in FIG. 4B, the fluidic registers 1.1–1.N may be curved into various shapes. Thus, the fluidic registers 1.1–1.N may be utilized to display images around curved or angled surfaces, e.g., building structures, walls, corners, and the like.

Figure 5:
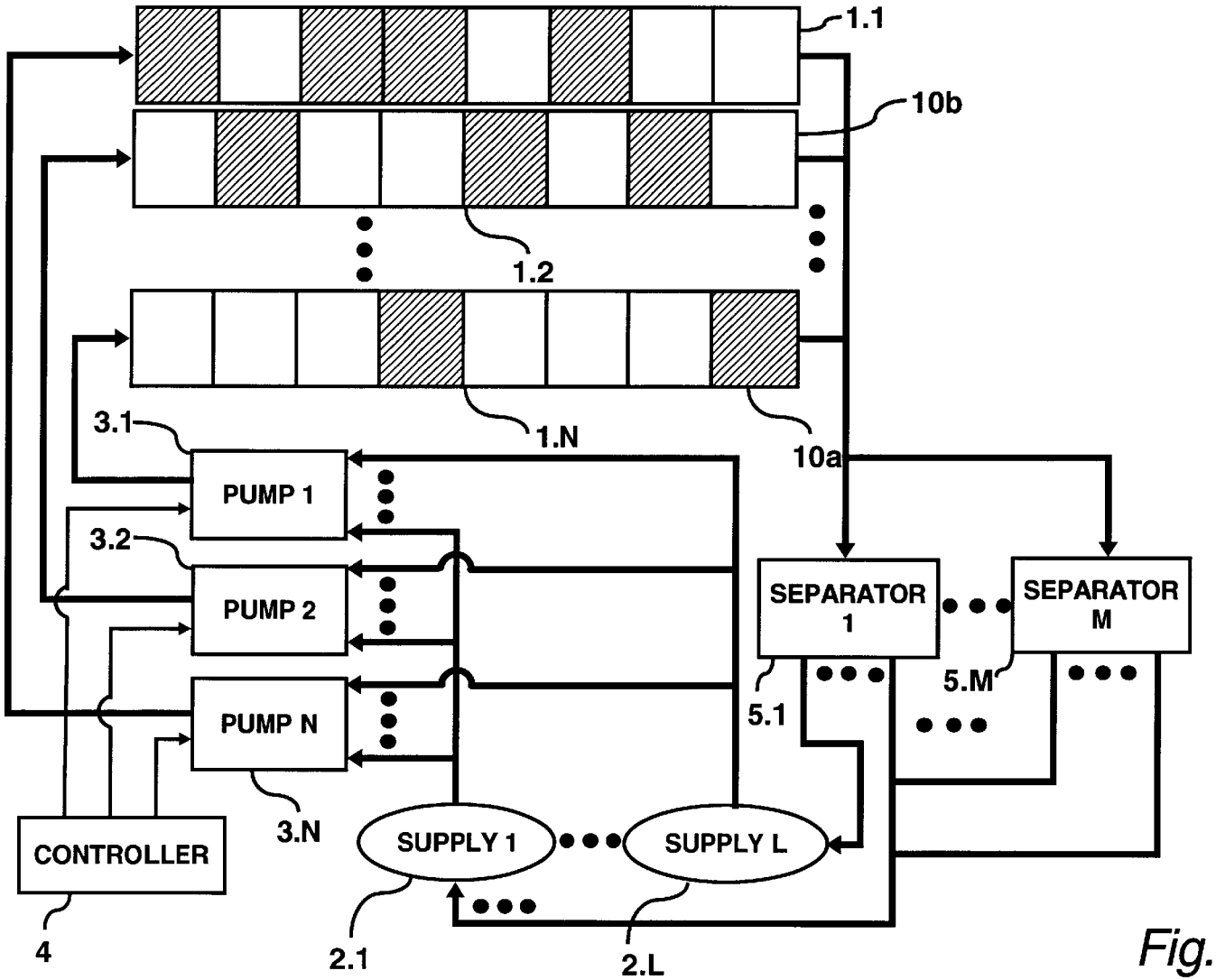
FIG. 5 is a schematic illustration of a fluidic data storage and display device, which is an extension of the fluidic data storage device as shown in FIG. 3A.

FIG. 5 illustrates a manner in which various types of fluids may be inserted into each of the fluidic registers 1.1–1.N in accordance with the principles of the present invention. This figure is similar to the fluidic data storage device shown in FIG. 3A. In FIG. 5, however, the fluidic data storage and display device includes a set of N transparent fluidic registers 1.1 to 1.N; a set of L fluid supplies 2.1 to 2.L, with each fluid supply storing a particular type of fluid; a set of N pumps 3.1 to 3.N with each pump receiving fluids from the set of fluid supplies and configured to pump the fluids to a particular member of the set of fluidic registers; a controller 4 configured to control each of the pumps; and a set of M fluid separators 5.1 to 5.M configured to receive the fluids ejected from the set of fluidic registers, each of the fluid separators being operable to separate and output the fluids to their respective fluid supplies. The fluids from the set of fluid supplies are such that no one fluid reacts with another of the fluids (i.e., the fluids are substantially immiscible with respect to each other).

In use, the fluids for the set of fluidic registers 1.1 to 1.N are supplied by the set of fluid supplies 2.1 to 2.L and pumped by the set of pumps 3.1 to 3.N. According to FIG. 6, there is a one-to-one correspondence between the set of fluidic registers and the set of pumps. That is, a particular pump 3.*x* is configured to pump the set of fluids to a particular fluidic register 1.*x* (x ranging from 1 to N).

While the above is one manner in which fluids may be pumped into the fluidic registers 1.1–1.N, other configurations are possible. For example, a pump may draw fluid from only one particular fluid supply and be configured to pump the fluid into each of the fluidic registers 1.1–1.N. In this instance, the controller 4 would select a particular fluidic register 1.*x* for the pump, e.g., pump 1, when data (i.e., fluid) is to be inserted into that fluidic register. More generally, a particular subset of pumps 3.*x*1 to 3.*x*2 may draw fluids from a particular subset of fluid supplies 2.*y*1 to 2.*y*2 and may pump the fluids to a particular subset of fluidic registers 1.*z*1 to 1.*z*2 (x1, x2, z1, and z2 ranging from 1 to N, y1 and y2 ranging from 1 to L). But in the aggregate, each fluidic register 1.1–1.N may be supplied with any of the fluids.

In addition, multiple fluid separators 5.1 to 5.M are in the set of fluid separators. In the configuration shown in FIG. 5, each fluid separator 5.*t* (t ranging from 1 to M) is capable of separating all fluids. While only one separator is necessary, multiple fluid separators may enhance reliability and capacity.

Although not shown, the display device as embodied in FIG. 5 may be expanded just as the storage device embodied in FIG. 3A was expanded to FIGS. 3B, 3C and 3D. For example, the pumps and the fluid separators may be connected to both ends of all fluidic registers to make the display device reversible. Also, to make the display device reversible, one set of pumps may be connected to first ends of the fluidic registers and another set of pumps may be connected to the second ends of the fluidic registers. Further, more than one set of pumps may be used to supply a subset of fluid supplies to the fluidic registers. It may easily be seen that many other possibilities exist.

It is also within the purview of the present invention that visual effects of the fluidic registers 1.1–1.N may be enhanced by the use of a visually appealing background (not shown). For example, a white background may serve to contrast the image displayed on the fluidic registers 1.1–1.N for lessening eye strain. Also, light sources may be used to contrast the image or provide other visual effects. Again, many possibilities exist As noted previously, certain advantages from certain embodiments of the present invention. For example, when relatively no power or force is applied, the data (i.e., fluid) within the fluidic registers 1.1–1.N remains static, i.e., the register is non-volatile. Additionally, the data (i.e., fluid) within the fluidic register 1 or registers 1.1–1.N may be meaningfully interpreted by a user without the need for an intermediate device. Furthermore, more than relatively simple binary types of data may be stored and displayed, which provides enhanced data storage and display capabilities.

While the invention has been described with reference to the exemplary embodiments thereof, those skilled in the art will be able to make various modifications to the described embodiments of the invention without departing from the true spirit and scope of the invention. The terms and descriptions used herein are set forth by way of illustration only and are not meant as limitations. In particular, although the method of the present invention has been described by examples, the steps of the method may be performed in a different order than illustrated or simultaneously. Those skilled in the art will recognize that these and other variations are possible within the spirit and scope of the invention as defined in the following claims and their equivalents.

What is claimed is:

1. A fluidic data storage device, comprising:

a fluidic register having a first end and a second end; and a first fluid supply containing a first fluid and a second fluid supply containing a second fluid, said first and second fluid supplies being operable to respectively supply said first and second fluids to said fluidic register, wherein said first and second fluids are substantially immiscible with respect to each other, and said first fluid and said second fluid represent data.

2. The device of claim 1, further comprising:

a pump configured to pump said first and second fluids from said first and second fluid supplies to said fluidic register; and a controller configured to control an operation of said at least one pump.

3. The device of claim 2, wherein said pump is configured to pump said first and second fluids into said first and second ends of said fluidic register.

4. The device of claim 1, wherein said first and second ends of said fluidic register are substantially open to allow passage of said first and second fluids through said first and second ends, and wherein a first fluid or a second fluid located adjacent said first end is ejectable from said first end when said first fluid or said second fluid is inserted through said second end and a first fluid or a second fluid located adjacent said second end is ejectable from said second end when said first fluid or said second fluid is inserted through said first end.

5. The device of claim 4, wherein said first and second fluids in said fluidic register are scrollable through insertion and ejection of said first and second fluids into and out of said fluidic register.

6. The device of claim 1, further comprising:

a fluid separator configured to separate said first and second fluids from said fluidic register and output said first and second fluids into said first and second fluid supplies, respectively.

7. The device of claim 1, further comprising:

a first pump configured to pump said first fluid from said first fluid supply to said fluidic register;

a second pump configured to pump said second fluid from said second fluid supply to said fluidic register; and a controller configured to control operations of said first and second pumps.

8. The device of claim 7, wherein said first pump is operable to pump said first fluid to said first and second ends of said fluidic register and said second pump is operable to pump said second fluid to said first and second ends of said fluidic register.

9. The device of claim 1, further comprising:

at least a first pump operable to pump said first and second fluids from said first and second fluid supplies into said first end of said fluidic register;

at least a second pump operable to pump said first and second fluids from said first and second fluid supplies into said second end of said fluidic register; and a controller operable to control operations of said first and second pumps.

10. The device of claim 1, wherein said first and second fluids are different from each other in at least one of a magnetic state, an electrical state, and a visual state.

11. The device of claim 1, wherein said fluidic register is flexible.

12. The device of claim 1, wherein said first and second fluids are visually discernible within the fluidic register.

13. The device of claim 12, wherein said first fluid comprises a first color and said second fluid comprises a second color.

14. The device of claim 1, wherein said first and second fluids are discernable by a machine.

15. The device of claim 1, further comprising:

a plurality of fluidic registers, each of said fluidic registers having a first end and a second end;

a plurality of fluid supplies operable to supply a corresponding number of fluids, wherein each of said number of fluids is relatively immiscible with respect to the other fluids of said number of fluids;

at least one pump operable to pump said set of fluid supplies to said set of fluidic registers; and at least one controller operable to control operations of said set of pumps.

16. The device of claim 15, wherein at least a subset of said at least one pump is operable to pump at least a subset of said number of fluids to a subset of said first and second ends of said plurality of fluidic registers.

17. The device of claim 15, further comprising a plurality of fluid separators operable to separate said number of fluids from said plurality of fluidic registers into said plurality of fluid supplies.

18. A method of storing data in fluidic form, said method comprising the steps of:

pumping a first fluid from a first fluid supply into a fluidic register having a first end and a second end; and pumping a second fluid, which is substantially immiscible with respect to said first fluid, from a second fluid supply into said fluidic register, wherein said first and second fluids are pumped into said fluidic register in accordance with the information said fluidic register is configured to store.

19. The method of claim 18, further comprising the step of:

pumping said first and second fluids into both said first and second ends of said fluidic register.

20. The method of claim 19, further comprising the step of:

ejecting at least one of said first and second fluids through one of said first and second ends in response to said step of pumping said first or second fluid into an opposite one of said first or second end to thereby allow said first and second fluid located within said fluidic register to scroll through said fluidic register.

21. The method of claim 18, further comprising:

separating said first and second fluids from said fluidic register into said first and second fluid supplies.

22. The method of claim 18, further comprising:

shaping said fluidic register to conform to spacing requirements.

23. A fluidic data storage device, comprising:

at least one fluidic register having first and second ends;

at least a first fluid supply for supplying a first fluid into said fluidic register;

at least a second fluid supply for supplying a second fluid, which is relatively immiscible with respect to said first fluid, into said fluidic register wherein said first fluid and said second fluid represent data;

at least one pump operable to pump said first and second fluids from said first and second fluid supplies to said fluidic register; and at least one controller for controlling an operation of said at least one pump.

24. The device of claim 23, further comprising at least one fluid separator for separating said first and second fluids from said fluidic register to said first and second fluid supplies, respectively.

25. A display device comprising:

a fluidic register having a first end and a second end;

a first fluid supply containing a first fluid and a second fluid supply containing a second fluid, said fluid supplies being operable to respectively supply said first and second fluids to said fluidic register, wherein said first and second fluids are substantially immiscible with respect to each other;

wherein said first fluid and said second fluids are visually discernable within said fluidic register;

wherein said first and second ends of said fluidic register are substantially open to allow passage of said first and second fluids through said first and second ends, and wherein a first fluid or a second fluid located adjacent said first end is ejectable from said first end when said first fluid or said second fluid is inserted through said second end and a first fluid or a second fluid located adjacent said second end is ejectable from said second end when said first fluid or said second fluid is inserted through said first end thereby enabling said first and second fluids located in said fluidic register to be scrolled by the insertion and ejection of said first and second fluids.

26. The display device of claim 25, wherein said first fluid comprises a first color and said second fluid comprises a second color.

* * * * *